US007755574B2

(12) United States Patent
Lee

(10) Patent No.: US 7,755,574 B2
(45) Date of Patent: Jul. 13, 2010

(54) PLASMA DISPLAY AND DRIVING METHOD THEREOF

(75) Inventor: Joo-Yul Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 345 days.

(21) Appl. No.: 12/018,128

(22) Filed: Jan. 22, 2008

(65) Prior Publication Data

US 2008/0180033 A1 Jul. 31, 2008

(30) Foreign Application Priority Data

Jan. 29, 2007 (KR) ..... 10-2007-0008864

(51) Int. Cl.
*G09G 3/28* (2006.01)

(52) U.S. Cl. ..... 345/60; 345/41; 345/66; 345/67

(58) Field of Classification Search ... 315/169.1–169.4; 345/41–42, 60, 63, 66–68, 204, 211, 690
See application file for complete search history.

(56) References Cited

U.S. PATENT DOCUMENTS 6,707,258 B2 * 3/2004 Lee ..... 315/169.3
6,933,679 B2 * 8/2005 Lee et al. ..... 315/169.4
7,642,994 B2 * 1/2010 Cho et al. ..... 345/66
2007/0152917 A1 * 7/2007 Moon ..... 345/67
2008/0111802 A1 * 5/2008 Yoon et al. ..... 345/204

* cited by examiner

*Primary Examiner*—David Hung Vu
*Assistant Examiner*—Tung X Le
(74) *Attorney, Agent, or Firm*—Christie, Parker & Hale, LLP

(57) ABSTRACT

In a plasma display device, a second terminal of a first transistor, whose first terminal is connected to an electrode, is connected to a power source for supplying a first voltage. A first driver is adapted to drive the first transistor to change the voltage of the electrode, and a second driver adapted to sustain the voltage of the electrode substantially at a second voltage differing from the first voltage by intercepting a path between the first transistor and the power source when the voltage of the electrode is changed into the second voltage in a first period, and to change the voltage of the electrode substantially back to the first voltage in a second period. In this way, it is possible to supply two or more voltages having a different voltage level by one power source.

20 Claims, 13 Drawing Sheets

PLASMA DISPLAY AND DRIVING METHOD THEREOF

CROSS-REFERENCE TO RELATED APPLICATION

This application claims priority to and the benefit of Korean Patent Application No. 10-2007-0008864, filed in the Korean Intellectual Property Office on Jan. 29, 2007, the entire content of which is incorporated herein by reference.

BACKGROUND OF THE INVENTION

1. Field of the Invention

The embodiments of the present invention relate to a plasma display device and a driving method thereof.

2. Description of the Related Art

A plasma display device is a display device that uses a plasma display panel (PDP) for displaying characters or images by using plasma generated by a gas discharge. The PDP includes a plurality of discharge cells arranged in a matrix pattern.

Generally, the PDP is driven by dividing one frame into a plurality of subfields. Grayscales are expressed by a combination of the weights of the subfields where a display operation occurs among the plurality of subfields. On cells (i.e., cells to be lighted) and off cells (i.e., cells not to be lighted) are selected by an address discharge during an address period of each subfield, and an image is displayed by a sustain discharge performed for the on cells during a sustain period.

A discharge occurs only when a voltage difference between two electrodes is set higher than a threshold voltage (that may be predetermined). Here, the level of a voltage used for each electrode in the address period and the sustain period is different, and accordingly the number of power sources supplying each of the voltages is relatively high (or is increased).

The above information disclosed in this Background section is only for enhancement of understanding of the background of the invention and therefore it may contain information that does not form the prior art that is already known in this country to a person of ordinary skill in the art.

SUMMARY OF THE INVENTION

An aspect of an embodiment of the present invention is directed to a plasma display device, which can reduce the number of power sources.

A plasma display device according to one embodiment of the present invention includes: an electrode; a first transistor connected between the electrode and a power source for supplying a first voltage and including a first terminal and a second terminal, a voltage of the first terminal corresponding to a voltage of the electrode and a voltage of the second terminal corresponding to the first voltage; a first driver adapted to drive the first transistor to change the voltage of the electrode; and a second driver adapted to sustain the voltage of the electrode substantially at a second voltage differing from the first voltage by intercepting a path between the first transistor and the power source when the voltage of the electrode is changed into the second voltage in a first period, and to change the voltage of the electrode substantially back to the first voltage in a second period.

A plasma display device according to another embodiment of the present invention includes: an electrode; a first transistor connected between the electrode and a power source and including a first terminal and a second terminal, a voltage of the first terminal corresponding to a voltage of the electrode and a voltage of the second terminal corresponding to a voltage of the power source; a first driver adapted to drive the first transistor to change the voltage of the electrode; a first resistor and a second resistor, the first and second resistors being connected in series between the electrode and the power source; a second transistor comprising a control terminal and adapted to turn on in response to a voltage of a node of the first and second resistors applied to the control terminal to turn off the first transistor when the second transistor is turned on; and a control signal voltage source adapted to supply a control signal, for turning off the second transistor, to the control terminal of the second transistor during a period.

A plasma display device according to another embodiment of the present invention includes: an electrode; a first transistor connected between the electrode and a power source and including a first terminal and a second terminal, a voltage of the first terminal corresponding to a voltage of the power source and a voltage of the second terminal corresponding to a voltage of the electrode; a first driver adapted to drive the first transistor to change the voltage of the electrode; a second transistor comprising a first terminal, a second terminal, and a control terminal, wherein the second transistor is adapted to be turned on in response to a voltage of a node of a first resistor and a second resistor, the first and second resistor being connected to each other in series and to both the first and second terminals of the second transistor, and wherein the second transistor is further adapted to intercept a path between the power source and the electrode when the second transistor is turned off; and a control signal voltage source adapted to supply a control signal, for turning off the second transistor, to the control terminal of the second transistor during a period.

According to another embodiment of the present invention, a driving method of a plasma display device including an electrode is provided. The driving method includes: turning on a first transistor connected between the electrode and a power source for supplying a first voltage to change a voltage of the electrode; sustaining the voltage of the electrode substantially at a second voltage differing from the first voltage by intercepting a path between the electrode and the power source when the voltage of the electrode is changed into the second voltage; and changing the voltage of the electrode substantially back to the first voltage through the path between the electrode and the power source.

DETAILED DESCRIPTION OF THE EMBODIMENTS

Figure 1:
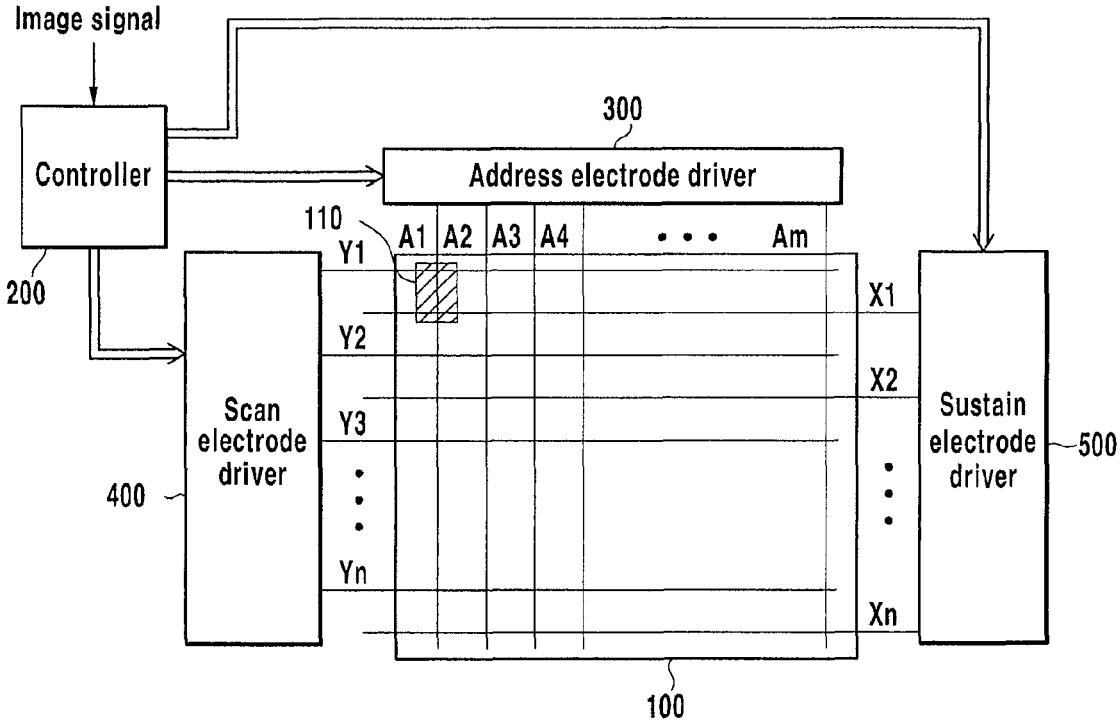
FIG. 1 is a view schematically showing a plasma display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that a first element is "coupled" or "connected" to a second element, the first element may be "directly coupled" or "directly connected" to the second element or be "electrically coupled" or "electrically connected" to the second element through one or more other elements. In addition, unless explicitly described to the contrary, the word "comprise", and variations such as "comprises" and "comprising", will be understood to imply the inclusion of stated elements but not the exclusion of any other elements.

The expression "a voltage is sustained" throughout the specification refers to the case where even if a potential difference between two specific points changes with a lapse in time, the change is within the scope allowable in terms of design or the change is caused by a parasitic component that can be ignored in the design. In addition, a threshold voltage of a semiconductor device (transistor, diode, etc.) is very low as compared to a discharge voltage, thus the threshold voltage is assumed to be about 0V voltage. Accordingly, the voltage applied to a node, an electrode, etc. by a power source includes a voltage which underwent a voltage change from the voltage of the power source due to a threshold voltage, a parasitic component or the like.

A plasma display device according to an exemplary embodiment of the present invention will be described in more detail below.

FIG. 1 is a view schematically showing a plasma display device according to an exemplary embodiment of the present invention.

As shown in FIG. 1, the plasma display device includes a plasma display panel 100, a controller 200, an address electrode driver 300, a scan electrode driver 400, and a sustain electrode driver 500.

The plasma display panel 100 includes a plurality of address electrodes (hereinafter, also referred to as "A electrodes") A1 to Am extending in a column direction. In addition, the plasma display panel 100 includes a plurality of sustain electrodes (hereinafter, also referred to as "X electrodes") X1 to Xn and a plurality of scan electrodes (hereinafter, also referred to as "Y electrodes") Y1 to Yn, which are paired, extending in a row direction. Generally, the X electrodes X1 to Xn are formed corresponding to the Y electrodes Y1 to Yn, and the X electrodes X1 to Xn and the Y electrodes Y1 to Yn are utilized to perform a display operation for displaying an image in a sustain period. The Y electrodes Y1 to Yn may cross the address electrodes A1 to Am, and the X electrodes X1 to Xn may cross the address electrodes A1 to Am. In this instance, discharge spaces provided at points where the address electrodes A1 to Am cross the X and Y electrodes X1 to Xn and Y1 to Yn form discharge cells 110

The above described structure of the plasma display panel 100 is only one example of the present invention, and a driving waveform to be explained in more detail below may be applicable to the above described structure and a panel of another structure.

The controller 200 receives an external image signal, and outputs an A electrode drive control signal, an X electrode drive control signal, and a Y electrode drive control signal. The controller 200 divides one frame into a plurality of subfields for driving. Each subfield has a reset period, an address period, and a sustain period with respect to time.

The address electrode driver 300 receives the A electrode drive control signal from the controller 200, and applies a display data signal for selecting desired discharge cells to the respective A electrodes.

The scan electrode driver 400 receives the X electrode drive control signal from the controller 200 and applies a driving voltage to the X electrodes.

The sustain electrode driver 500 receives the Y electrode drive control signal from the controller 200 and applies a driving voltage to the Y electrodes.

Figure 2:
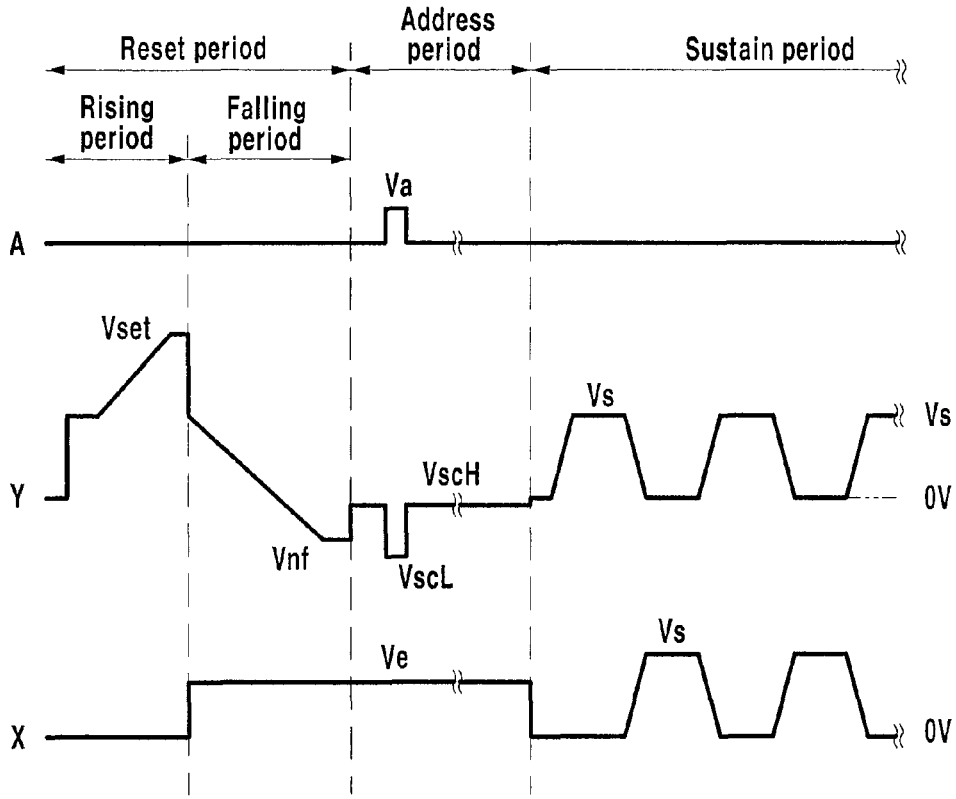
FIG. 2 is a view schematically showing a driving waveform of a plasma display device according to an exemplary embodiment of the present invention.

FIG. 2 is a view schematically showing a driving waveform of a plasma display device according to an exemplary embodiment of the present invention. For the convenience of explanation, FIG. 2 has illustrated only a driving waveform of one of a plurality of subfields constituting one frame, and only a driving waveform applied to the X electrodes, the Y electrodes and the A electrodes forming one discharge cell.

As shown in FIG. 2, during the rising period of the reset period, the address electrode driver 300 and the sustain electrode driver 500 have the A electrode and the X electrode biased at a reference voltage (e.g., 0V in FIG. 2), and the scan electrode driver 400 gradually increase the voltage of the Y electrode from a voltage Vs to a voltage Vset. FIG. 2 illustrates that the voltage of the Y electrode increases according to a ramp pattern. As the voltage of the Y electrode is increased, a weak discharge is generated between the Y and X electrodes and between Y and A electrodes, and (−) wall charges are formed on the Y electrode and (+) wall charges are formed on the X and A electrodes.

During the falling period of the reset period, the sustain electrode driver 500 has the X electrodes biased at a voltage Ve, and the scan electrode driver 400 gradually decreases the voltage of the Y electrode from the voltage Vs to a voltage Vnf. FIG. 2 illustrates that the voltage of the Y electrode decreases according to a ramp pattern. As a result, a weak discharge is generated between the Y and X electrodes and between the Y and A electrodes while the voltage of the Y electrode is reduced, and accordingly, the (−) wall charges formed on the Y electrode and the (+) wall charges formed on the X and A electrodes are eliminated. A voltage (Vnf-Ve) is set to be close to a discharge firing voltage between the Y and X electrodes. Then, a wall voltage between the Y and X electrodes reaches near 0V, and therefore, a cell that was not addressed with an address discharge during the address period may be prevented (or blocked) from misfiring during the sustain period.

Generally, when the voltage Vnf is applied in the reset period, a sum of the wall voltage between the A and Y electrodes and the external voltage Vnf between the A and the Y electrodes is determined by the discharge firing voltage Vfay between the A and Y electrodes. When 0V is applied to the A electrode and the voltage VscL, that is equal to Vnf in this case, is applied to the Y electrode in the address period, the voltage Vfay is formed between the A and Y electrodes, and accordingly generation of a discharge may be expected. However, in this case, the expected discharge is not generated because a discharge delay is greater than the width of the scan pulse and the address pulse. However, if the voltage Va is applied to the A electrode and the voltage VscL=Vnf is applied to the Y electrode, a voltage greater than the firing voltage Vfay is formed between the A and Y electrodes, and accordingly, the discharge delay is reduced to less than the width of the scan pulse, allowing a discharge to be generated. In this case, where the voltage of VscL is set to be a voltage lower than the voltage of Vnf, the voltage difference of (VscL−Va) between the Y electrode and the A electrode is increased and the address discharge is properly generated. Also, the voltage of Va is reduced by as much as the voltage difference of (VscL-Vnf). Therefore, in the address period, the voltage of VscL is set to be equal to or lower than the voltage of Vnf, and the voltage of Va is set to be higher than the reference voltage.

During the address period, the scan electrode driver 400 and the address electrode driver 300 apply scan pulses to the Y electrode (Y1 of FIG. 1) in the first row, and at the same time (or substantially the same time) apply address pulses to the A electrode disposed in the on cells in the first row. Then, a discharge is generated between the Y electrode in the first row and the A electrode having the address pulses applied thereto. Accordingly, (+) wall charges are formed on the Y electrode and (−) wall charges are formed on the A electrode and the X electrode. Subsequently, the scan electrode driver 400 and the address electrode driver 300 apply scan pulses to the Y electrode (Y2 of FIG. 1) in the second row, and, at the same time (or substantially the same time), apply address pulses to the A electrode disposed in the on cells in the first row. Then, the address discharge is generated in the cells formed by the A electrodes having the address pulses applied thereto and the Y electrode in the second row (Y2); and, accordingly, wall charges are formed in those cells. In the same manner (or substantially the same manner), the scan electrode driver 400 and the address electrode driver 300 sequentially apply scan pulses to the Y electrodes in other rows and address pulses to the A electrodes disposed in the on cells, thereby forming wall charges.

In the cells where the address discharge is generated in the address period, that is, the on cells (i.e., the light emitting cells), a wall voltage of the Y electrode with respect to the X electrode is high. Thus, in the sustain period, the scan electrode driver 400 and the sustain electrode driver 500 apply sustain discharge pulses having the voltage Vs to the Y electrode and a ground voltage to the X electrode, thereby generating a sustain discharge between the Y electrode and the X electrode. As a result of the sustain discharge, the (−) wall charges are formed on the Y electrode and the (+) wall charges are formed on the electrodes, such that the wall voltage of the Y electrode with respect to the X electrode is high.

Subsequently, the scan electrode driver 400 and the sustain electrode driver 500 apply the ground voltage to the Y electrode and sustain discharge pulses having the voltage Vs to the X electrode, thereby generating a sustain discharge between the Y electrode and the X electrode. As a result, (+) wall charges are formed on the Y electrode and (−) wall charges are formed on the X electrodes such that another sustain discharge may be generated when a sustain discharge pulse having the voltage Vs is applied to the Y electrode by applying the positive voltage Vs to the Y electrode. The process for applying a sustain discharge pulse to the Y electrode and the X electrode is repeated a number of times corresponding to the weight associated with the corresponding subfield, thereby displaying an image.

Although FIG. 2 illustrates that the sustain discharge pulse having the voltage Vs is alternately applied to the Y electrode and the X electrode, a sustain discharge pulse having a voltage difference between the Y electrode and the X electrode of a voltage Vs and/or a voltage −Vs, may be alternately applied to the Y electrode and/or the X electrode. For example, with the X electrode being biased at the ground voltage, a sustain discharge pulse alternately having the voltages Vs and −Vs may be applied to the Y electrode.

In addition, although FIG. 2 illustrates a case where the cells are initialized to off cells by eliminating the wall charges of the cells and then the cells are set to on cells through an address discharge in the address period, it may be also possible to set the cells to off cells through an address discharge in the address period after setting the cells to on cells by writing the wall charges in the cells in the rest period or after the sustain period of the preceding subfield.

Figure 3:
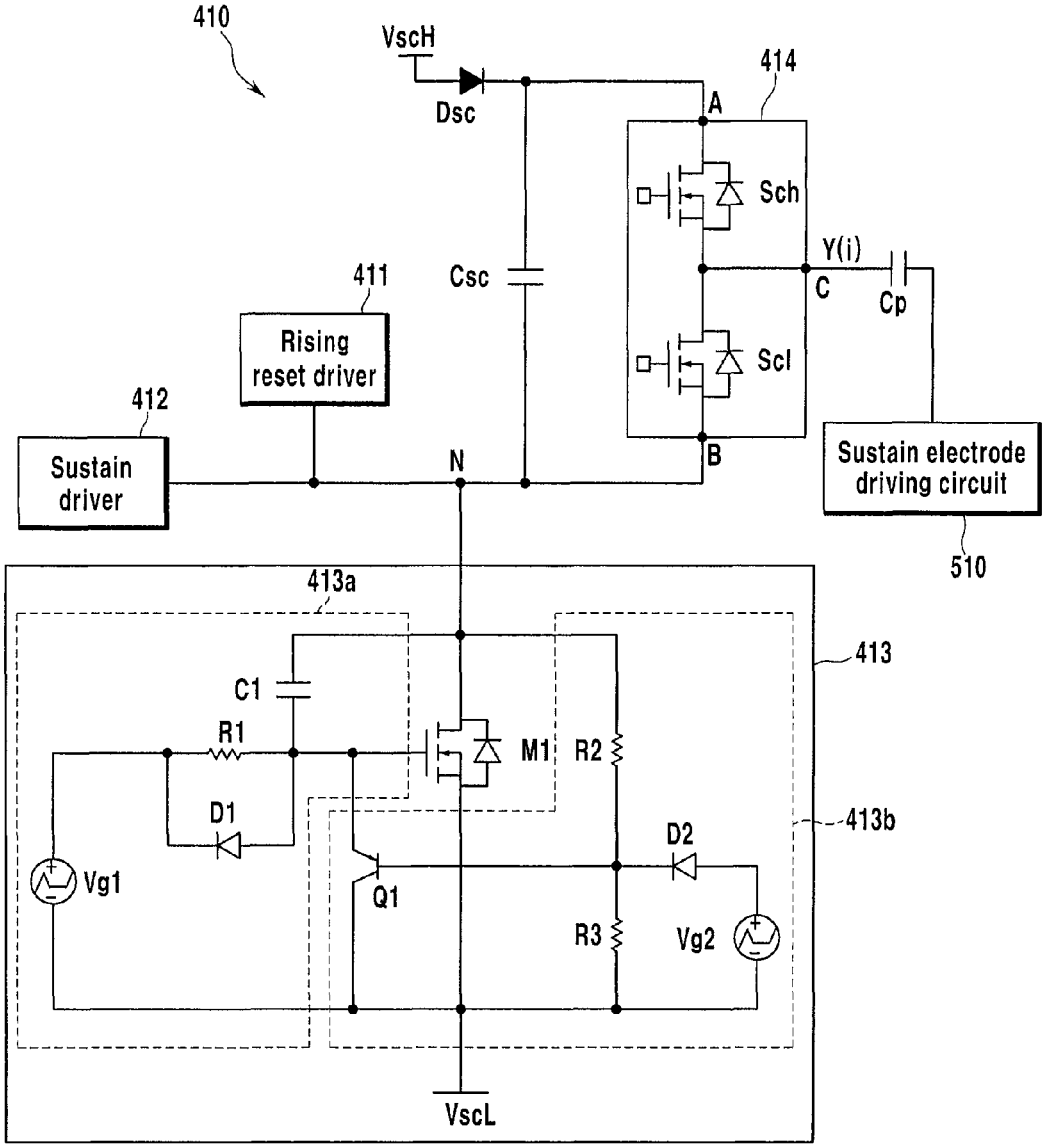
FIG. 3 is a view schematically showing a scan electrode driving circuit according to a first exemplary embodiment of the present invention.

Hereinafter, a driving circuit capable of implanting voltages of different levels by one power source will be described in more detail with reference to FIG. 3. FIG. 3 illustrates the case where the voltage Vnf applied to the Y electrode in the rest period and the voltage VscL applied to the Y electrode in the address period can be implemented.

FIG. 3 is a view schematically showing a scan electrode driving circuit according to a first exemplary embodiment of the present invention. The scan electrode driving circuit 410 may be formed in the scan electrode driver 400, and the sustain electrode driving circuit 510 connected to the X electrode X may be formed in the sustain electrode driver 500. For the convenience of explanation, only one Y electrode Yi has been described, and a capacitive component formed by one Y electrode Yi and one X electrode X is illustrated as a panel capacitor Cp. It is assumed that the voltage Vs is applied to the Y electrode before a falling ramp waveform is applied in the falling period.

As shown in FIG. 3, the scan electrode driving circuit 410 according to a first exemplary embodiment of the present invention includes a rising reset driver 411, a sustain driver 412, a falling reset/scan driver 413, a scan circuit 414, a capacitor Csc, and a diode Dsc.

The scan circuit 414 has a first input terminal A and a second input terminal B. An output terminal C is connected to a Y electrode Yi. A voltage of the first input terminal A and a voltage of the second input terminal B are selectively applied to the corresponding Y electrode in order to select on cells in the address period. Although FIG. 3 illustrates one scan circuit 414 connected to the Y electrode Yi, respective scan circuits 414 are connected to a plurality of Y electrodes Y1 to Yn. In addition, a number (or predetermined number) of scan circuits 414 are formed as one scan integrated circuit IC, and thus a plurality of output terminals of the scan integrated circuit may be connected to the number of Y electrodes, respectively.

The scan circuit 414 includes transistors Sch and Scl. The source of the transistor Sch and the drain of the transistor Scl are coupled to the Y electrode Yi of the panel capacitor Cp. The drain of the transistor Sch is connected to the first input terminal A. A power source Vsch for supplying a voltage Vsch is connected to the first input terminal A, and a cathode of the diode Dsc, whose anode is connected to the power source VscH, is connected to the second input terminal B. The source of the transistor Scl is connected to the second input terminal B, and the second input terminal B is connected to a node N.

The capacitor Csc is connected between the first input terminal A and the second input terminal B.

The failing reset/scan driver 413 is connected to the node N, and the falling reset/scan driver 413 includes a transistor M1 and drivers 413*a* and 413*b*. The driver 413*a* includes a capacitor C1, a resistor R1, a diode D1, and a control signal voltage source Vg1, and the driver 413*b* includes a transistor Q1, resistors R2 and R3, a diode D2, and a control signal voltage source Vg2. A voltage source VscL for supplying a voltage VscL is connected to the source of the transistor M1 whose drain is connected to the node N. A second terminal of the capacitor C1, whose first terminal is connected to the drain of the transistor M1, is connected to a gate, which is a control terminal of the transistor M1. One end of the resistor R1 and the anode of the diode D1 are connected to the second terminal of the capacitor C1, and a control signal voltage source Vg1 is connected to the other end of the resistor R2 and between the cathode of the diode D1 and the power source VscL. The transistor M1 is driven by the driver 413*a*, thereby reducing the voltage of the Y electrode in a ramp pattern.

The two resistors R2 and R3 are connected in series between the drain of the transistor M1 and the power source VscL, and the contact between the two resistors R2 and R3 is connected to a base, which is the control terminal of the transistor Q1. A collector of the transistor Q1 is connected to the power source VscL, and an emitter of the transistor Q1 is connected to the gate of the transistor M1. In addition, the cathode of the diode D2 is connected to the contact between the two resistors R2 and R3, and the control voltage signal source Vg2 is connected between the anode of the diode D2 and the power source VscL. The driver 413*b* turns on the transistor Q1 when the voltage of the Y electrode Yi reaches a certain (or predetermined) voltage, thereby intercepting a path between the transistor M1 and the power source VscL.

The sustain driver 412 is connected to the node N, applies a sustain discharge pulse having a voltage Vs to the plurality of Y electrodes Yi through the second input terminal B of the scan circuit 414 during the sustain period, and the rising reset driver 411 is connected to the node N and applies a rising reset waveform to the Y electrode Yi through the second input terminal B of the scan circuit 414 during the rising period of the reset period.

The operation of the falling reset/scan driver 413 as shown in FIG. 3 will be described in more detail with reference to FIG. 4.

Figure 4:
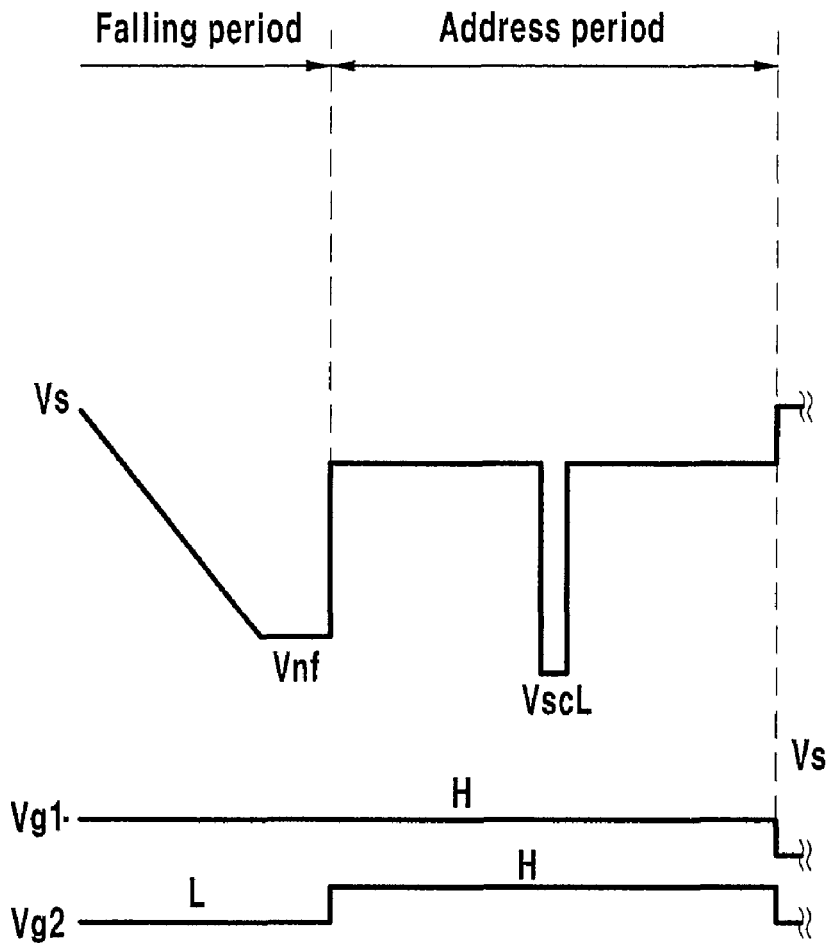
FIG. 4 is a view schematically showing a timing of the driving circuit as shown in FIG. 3.

FIG. 4 is a view schematically showing a timing of the driving circuit as shown in FIG. 3.

First, in the reset period, the transistor Scl of the scan circuit 414 of FIG. 3 is turned on (or is always on) to apply the voltage of the Y electrode Yi of the panel capacitor Cp to the node N.

As shown in FIG. 4, a high level signal H is outputted from the control signal voltage source Vg1 during the falling period of the reset period, and a low level signal L is outputted from the control signal voltage source Vg2. Then, the voltage of the Y electrode Yi is gradually decreased.

That is, as a high level signal H is outputted from the control signal voltage source Vg1, a gate voltage of the transistor M1 is increased by a capacitance component formed by the capacitor C1 and the parasitic capacitor of the transistor M1 and the path formed by the resistor R1. Then, the n-channel transistor M1 is turned on, thereby reducing the voltage of the Y electrode Yi through the path of the panel capacitor Cp, the transistor M1, and the voltage source VscL. As the voltage of the Y electrode Yi is decreased, the gate voltage of the transistor M1 is decreased by the capacitor C1, thereby turning off the transistor M1.

As the gate voltage of the transistor M1 is increased again by the high level signal H, the transistor M1 is turned on again. Then the voltage of the Y electrode Yi is reduced again.

In this way, the transistor M1 is repeatedly turned on and turned off, thereby gradually reducing the voltage of the Y electrode Yi. In addition, the voltage of the Y electrode Yi, that is, the voltage of the node N, is reduced to a voltage Vx, the voltage Vx is divided by the two resistors R2 and R3, and a base-collector voltage of the transistor Q1 becomes the voltage Vb as shown in Equation 1. At this time, the base-collector voltage Vbc of the transistor Q1 becomes lower than a threshold voltage Vth as is shown in Equation 2, and the transistor Q1 is turned on. Accordingly, the gate-source voltage of the transistor M1 becomes a voltage of 0V, thus the transistor M1 is turned off. That is, when the base-collector voltage Vbc of the transistor Q1 is approximately equal to a threshold voltage |Vth|, the voltage Vx of the node N becomes a voltage Vnf, and the Y electrode can sustain the voltage Vnf during a certain (or predetermined) period.

$$Vb = VscL + (Vx - VscL)\frac{R3}{(R2 + R3)} \quad \text{Equation 1}$$

$$Vbc = (Vx - VscL)\frac{R3}{(R2 + R3)} \leq |Vth| \quad \text{Equation 2}$$

In the address period, a high level signal H is outputted from the control signal voltage source Vg2. Then, the base-collector voltage Vbc of the transistor Q1 becomes greater than the threshold voltage Vth, thereby turning off the transistor Q1. Accordingly, the voltage of the Y electrode is gradually decreased to the voltage VscL by turning on and off the transistor M1 again. In this state, the transistor Scl of the scan circuit 414, connected to the Y electrode of the cell to be turned on, is turned on, and the voltage VscL can be applied to the Y electrode of the cell to be turned on.

In this way, the scan electrode driving circuit 410 according to the first exemplary embodiment of the present invention can supply both the voltage Vnf and the voltage VscL by one power source VscL.

Another exemplary embodiment in which both the Vnf voltage and the VScL voltage can be supplied by one power source VscL will be described in more detail with reference to FIG. 5.

Figure 5:
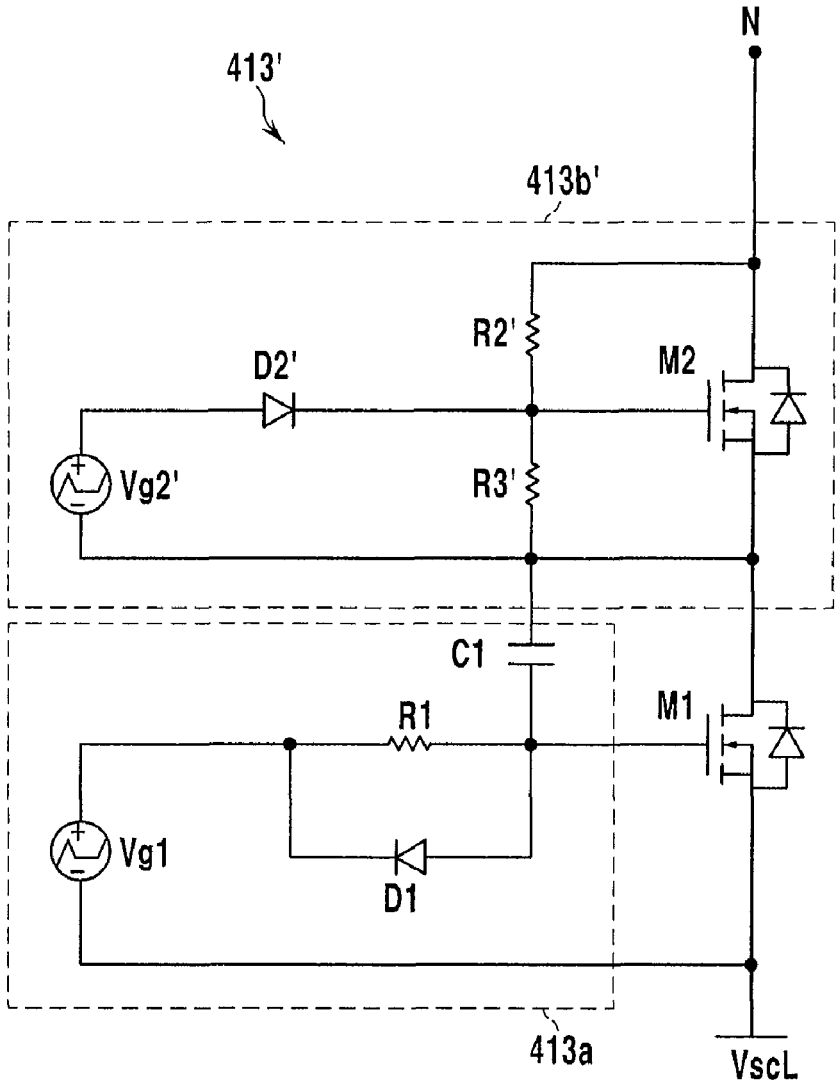
FIG. 5 is a view schematically showing a scan electrode driving circuit according to a second exemplary embodiment of the present invention.

FIG. 5 is a view showing a scan electrode driving circuit according to a second exemplary embodiment of the present invention. FIG. 5 illustrates only the falling reset/scan driver for the convenience of explanation.

As shown in FIG. 5, the falling reset/scan driver 413' is the same (or substantially the same) as the falling reset/scan driver 413 of the scan electrode driving circuit 410 according to the first exemplary embodiment of the present invention except for the driver 413*b*'. The driver 413*b*' includes a transistor M2, resistors R2' and R3', a diode D2', and a control signal voltage source Vg2'. A drain of the transistor M2 is connected to the node N, and a source of the transistor M2 is connected to a drain of the transistor M1. The two resistors R2' and R3' are connected in series between the drain of the transistor M2 and the source of the transistor M2. The control signal voltage source Vg2' is connected between a cathode of the diode D2' (the cathode being connected to the contact between the two resistors R2' and R3') and the source of the transistor M2.

The falling reset/scan driver 413' turns off the transistor M2 when the voltage of the Y electrode Yi becomes a certain (or predetermined) voltage, thereby intercepting a path between the transistor M1 and the node N. That is, during the falling period of the reset period, if a high level signal H is outputted from the control signal voltage source Vg1, a voltage divided by the two resistors R2 and R3 is applied to the gate of the transistor M2, and the gate-source voltage Vgs of the transistor M2 becomes higher than a threshold voltage Vth of the transistor M2, thereby turning on the transistor M2. In this way, the transistor M1 is repeatedly turned on and turned off, thereby gradually reducing the voltage of the Y electrode Yi. In addition, the voltage of the Y electrode Yi, that is, the voltage of the node N, is reduced to a certain (or predetermined) voltage Vx, the voltage Vx is divided by the two resistors R2 and R3, and a gate-source voltage Vgs of the transistor M2 becomes lower than the threshold voltage Vth, thereby turning off the transistor M2. When the gate-source voltage Vgs of the transistor M2 is approximately equal to a threshold voltage |Vth'|, the voltage Vx of the node N becomes a voltage Vnf, and the Y electrode can sustain the voltage Vnf during a certain (or predetermined) period.

Subsequently, in the address period, a high level signal H is outputted from the control signal voltage source Vg2'. Then, the gate-source voltage Vgs of the transistor M2 becomes greater than the threshold voltage Vth, thereby turning on the transistor M2. Accordingly, the voltage of the Y electrode is gradually decreased to the voltage VscL by turning on and off the transistor M1 again. In this state, the transistor Scl of the scan circuit 414, connected to the Y electrode of the cell to be turned on, is turned on, the voltage VscL can be applied to the Y electrode of the cell to be turned on.

Also, the operating principle of the falling reset/scan drivers 413 and 413' according to the first and second exemplary embodiments of the present invention is not limited to the voltages Vnf and VscL applied to the Y electrode. These exemplary embodiments will be described below in more detail with reference to FIGS. 6 to 9.

Figure 6:
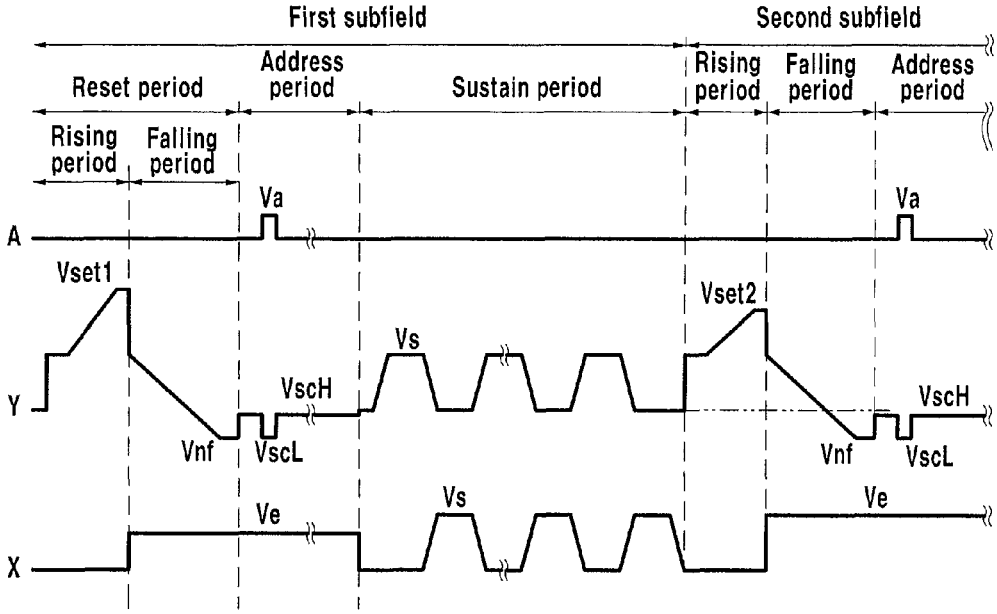
FIG. 6 is a view schematically showing a driving waveform of a plasma display device according to the second exemplary embodiment of the present invention.

FIG. 6 is a view schematically showing a driving waveform of a plasma display device according to the second exemplary embodiment of the present invention. FIGS. 7 to 10 are views schematically showing a scan electrode driving circuit according to third to sixth exemplary embodiments of the present invention. FIG. 6 illustrates only two of a plurality of subfields for the convenience of explanation.

As shown in FIG. 6, as the subfields have a higher weight value, more discharge priming is formed, and thus it is possible to reduce a voltage Vset in the rising period of the reset period as the subfields have a higher value. That is, in the first subfield, the voltage of the Y electrode can be gradually increased to a voltage Vset1 in the rising period of the reset period, and in the second subfield having a higher weight value than the first subfield, the voltage of the Y electrode can be gradually increased to a voltage Vset2 which is lower than the voltage Vset1.

Figure 7:
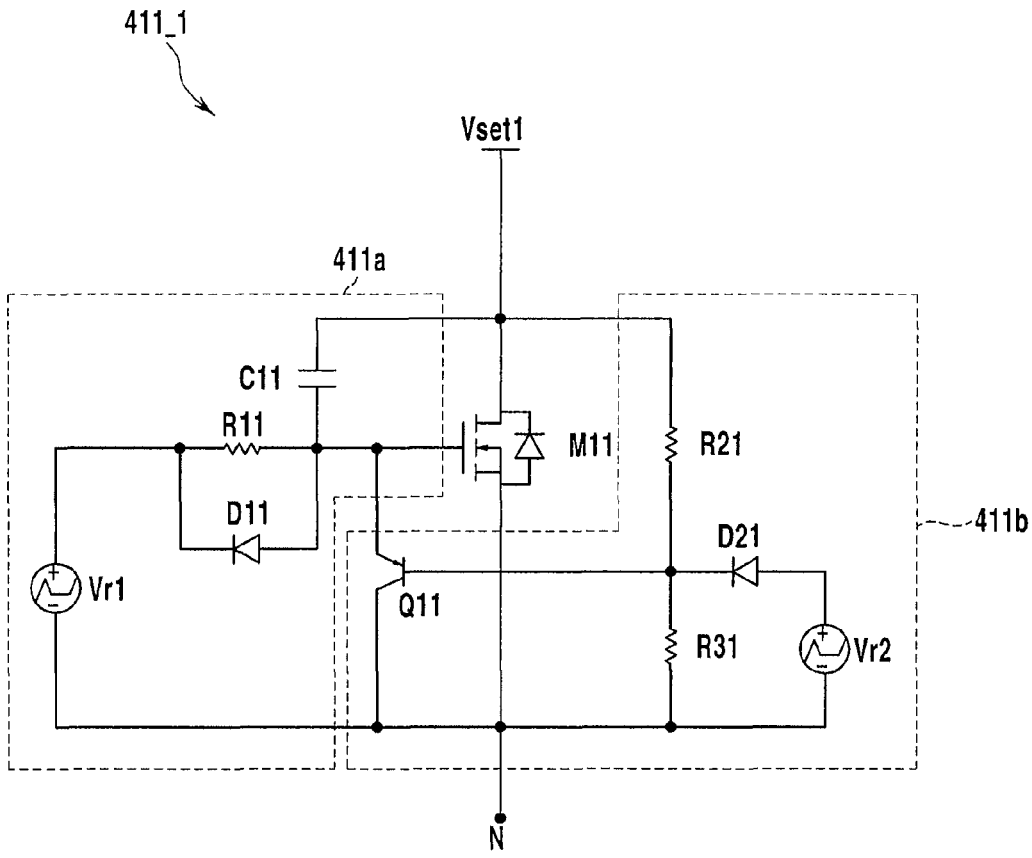
FIGS. 7, 8, 9, and 10 are views schematically showing a scan electrode driving circuit according to third, fourth, fifth, and sixth exemplary embodiments of the present invention.
Figure 8:
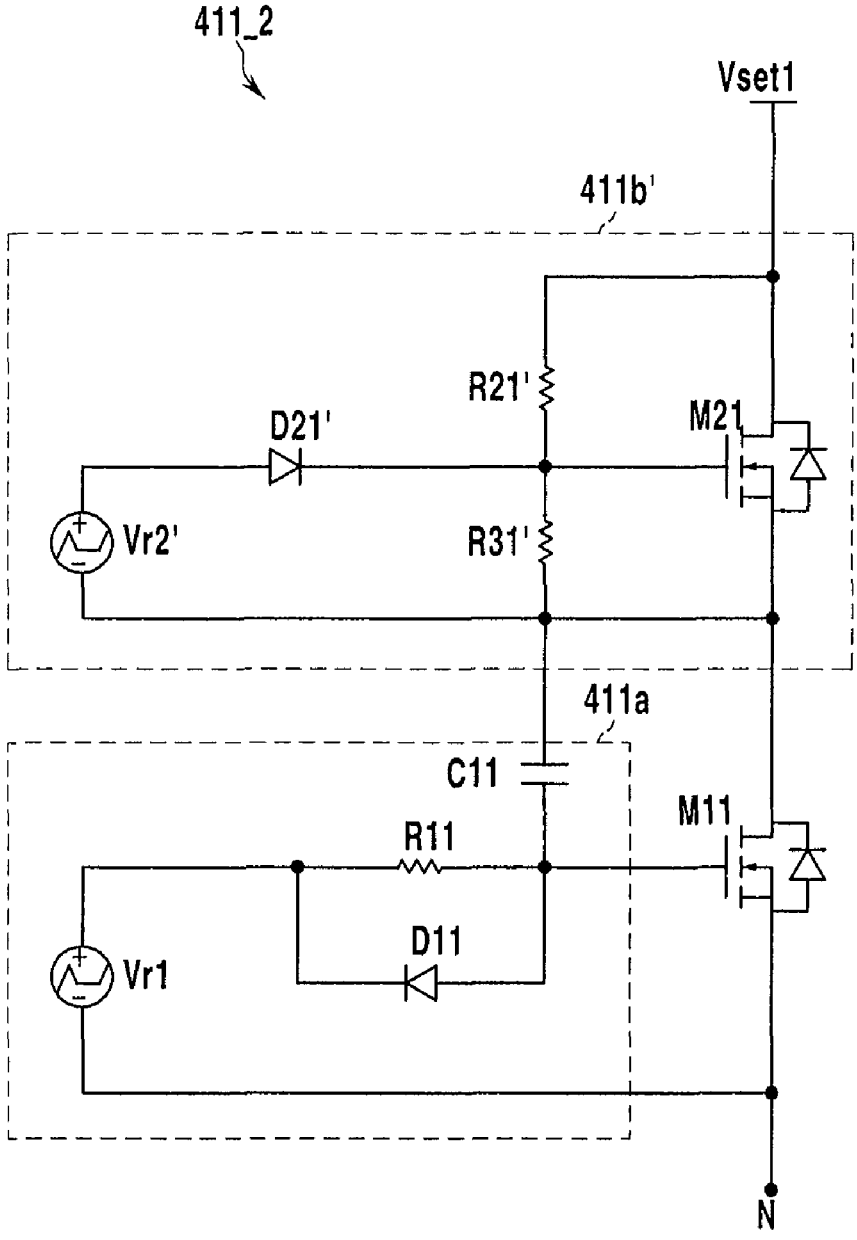

As above, during the rising period of the reset period of each subfield, if a driving circuit is constructed as shown in FIGS. 7 and 8, even if final voltages Vset1 and Vset2 applied to the Y electrode are different from each other, the voltage Vset1 and the voltage Vset2 can be supplied by one power source Vset1. In addition, the driving circuit as shown in FIGS. 7 and 8 may be formed in the rising reset driver.

As shown in FIG. 7, the rising reset driver 411_1 includes a transistor M11 and drivers 411*a* and 411*b*. The driver 411*a* includes a capacitor C11, a resistor R1, a diode D11, and a control signal voltage source Vr1, and the driver 411*b* includes a transistor Q11, resistors R21 and R31, a diode D21, and a control signal voltage source Vr2. Here, a drain of the transistor M11 is connected to a voltage source Vset1 for supplying a voltage Vset1, and a source of the transistor M11 is connected to a node N. In addition, a second terminal of the capacitor C11, whose first terminal is connected to the drain of the transistor M11, is connected to a gate of the transistor M11. In addition, an anode of the diode D11 is connected to the second terminal of the capacitor C1, and the control signal voltage source Vr1 is connected between the cathode of the diode D11 and the node N. The resistor R11 is connected between the anode and cathode of the diode D11. The transistor M11 is driven by the driver 411*a*, thereby increasing the voltage of the Y electrode in a ramp pattern.

In addition, the two resistors R21 and R31 are connected in series between the source of the transistor M11 and the node N, and the contact between the two resistors R21 and R31 is connected to the base of the transistor Q11. A collector of the transistor Q1 is connected to the node N, and an emitter of the transistor Q11 is connected to the gate of the transistor M11. In addition, the cathode of the diode D21 is connected to the contact between the two resistors R21 and R31, and the control voltage signal source Vr2 is connected between the anode of the diode D21 and the node N. The driver 411*b* turns on the transistor Q11 when the voltage of the Y electrode Yi reaches a certain (or predetermined) voltage, thereby intercepting a path between the transistor M1 and the node N.

In the thus-constructed rising reset driver 411_1, a high level signal H and a low level signal L are respectively outputted from the control signal voltage sources Vr1 and Vr2 in the rising period of the reset period of the first subfield, thereby gradually increasing the voltage Yi of the Y electrode to a voltage Vset1. In addition, in the rising period of the reset period of the second subfield, a high level signal H and a low level signal L are respectively outputted from the control signal voltage sources Vr1 and Vr2, to thus gradually increase the voltage Yi of the Y electrode. Then, when the voltage Vx of the Y electrode Yi is increased to a certain (or predetermined) voltage Vx, the transistor Q11 is turned on. That is, when the base-collector voltage of the transistor Q11 is approximately equal to a threshold voltage |Vth|, the voltage Vx of the node N becomes a voltage Vset2, and the Y electrode can sustain the voltage Vset2 during a certain (or predetermined) period.

In addition, as shown in FIG. 8, the rising reset driver 411_2 is the same as the rising reset driver 411_1 as shown in FIG. 7 except for the driver 411*b*'. The driver 411*b*' includes a transistor M21, resistors R21' and R31', a diode D21', and a control signal voltage source Vr2'. A drain of the transistor M21 is connected to the power source Vset1, and a source of the transistor M21 is connected to the drain of the transistor M1. The two resistors R21' and R31' are connected in series between the drain of the transistor M21 and the source of the transistor M21, and the contact between the two resistors R21' and R31' is connected to a gate of the transistor M21. The control signal voltage source Vr2' is connected between an anode of the diode D21', whose cathode is connected to the contact between the two resistors R21' and R31', and the source of the transistor M21.

The driver 411*b*' turns off the transistor M21 when the voltage of the Y electrode Yi reaches a certain (or predetermined) voltage, thereby intercepting a path between the transistor M21 and the voltage source Vset1.

That is, during the rising period of the reset period, if a high level signal H is outputted from the control signal voltage source Vr2, the transistor M2 is turned on by a voltage divided by the two resistors R21 and R31

In this way, the transistor M1 is repeatedly turned on and turned off, thereby gradually increasing the voltage of the Y electrode Yi to the voltage Vset1.

In addition, in the rising period of the reset period of the second subfield, a high level signal H is outputted from the control signal voltage source Vr2, to thus gradually increase the voltage Yi of the Y electrode. Then, when the voltage Vx of the Y electrode Yi is increased to a certain (or predetermined) voltage Vx, the transistor M21 is turned off. That is, when the gate-source voltage Vgs of the transistor M21 is approximately equal to a threshold voltage |Vth|, the voltage Vx of the node N becomes a voltage Vset2, and the Y electrode can sustain the voltage Vset2 during a certain (or predetermined) period.

Also, in the rising period of the reset period of the third subfield having a higher weight value than the second subfield, the voltage of the Y electrode can be gradually increased to a voltage Vset3 which is lower than the voltage Vset2 according to one embodiment of the present invention. In this case, as shown in FIGS. 9 and 10, a driving circuit is constructed.

Figure 9:
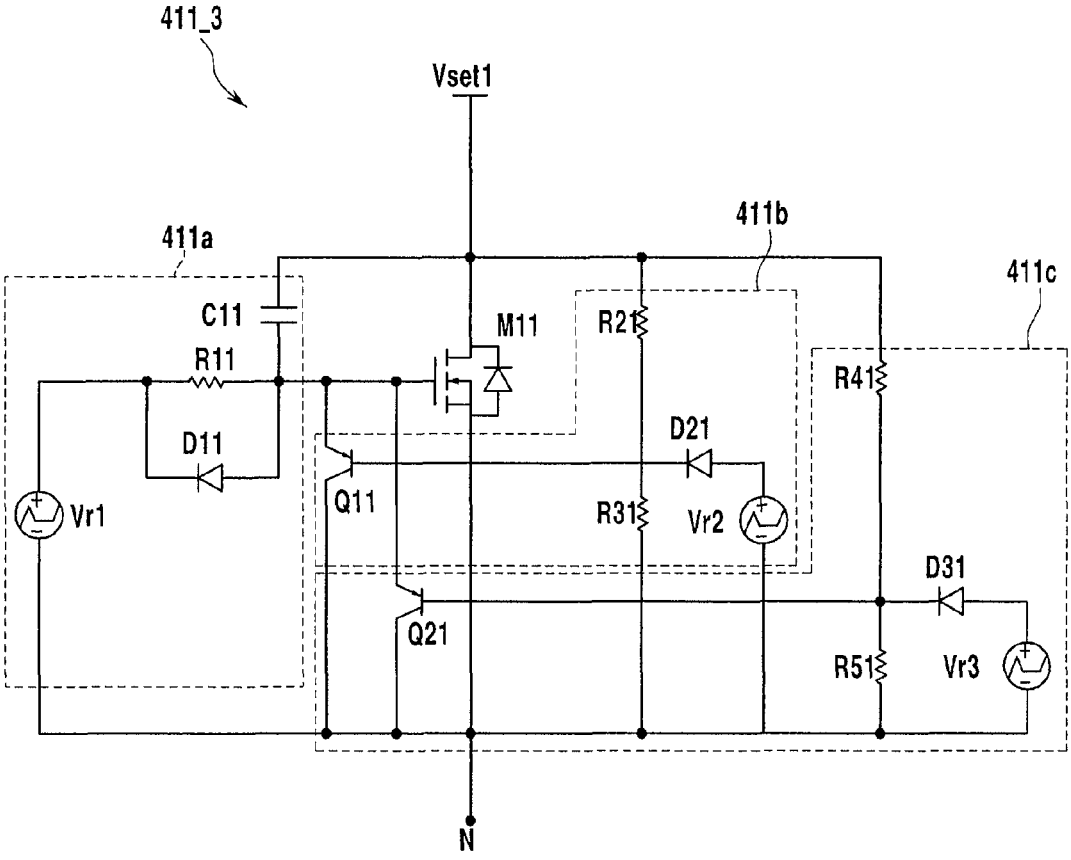

First, as shown in FIG. 9, the rising reset driver 411_3 is the same (or substantially the same) as the rising reset driver 411_1 as shown in FIG. 7 except that it further includes a driver 411*c*. The driver 411*c* includes a transistor Q21, resistors R41 and R51, a diode D31, and a control signal voltage source Vr3. The two resistors R41 and R51 are connected in series between the drain of the transistor M11 and the node N, and the contact between the two resistors R41 and R51 is connected to the base of the transistor Q21. A collector of the transistor Q21 is connected to the node N, and an emitter of the transistor Q21 is connected to a gate of the transistor M11. In addition, the cathode of the diode D31 is connected to the contact between the two resistors R4 and R5, and the control voltage signal source Vr3 is connected between the anode of the diode D31 and the node N. The driver 411*c* turns on the transistor Q11 when the voltage of the Y electrode Yi reaches a certain (or predetermined) voltage, thereby intercepting a path between the transistor M11 and the node N. That is, the voltage Yi of the Y electrode is gradually increased, and then when the voltage Vx of the Y electrode Yi is increased to a certain (or predetermined) voltage Vx, the transistor Q21 is turned on. That is, when the base-collector voltage of the transistor Q11 is approximately equal to a threshold voltage |Vth|, the voltage Vx of the node N becomes a voltage Vset3, and the Y electrode Yi can sustain the voltage Vset3 during a certain (or predetermined) period.

Figure 10:
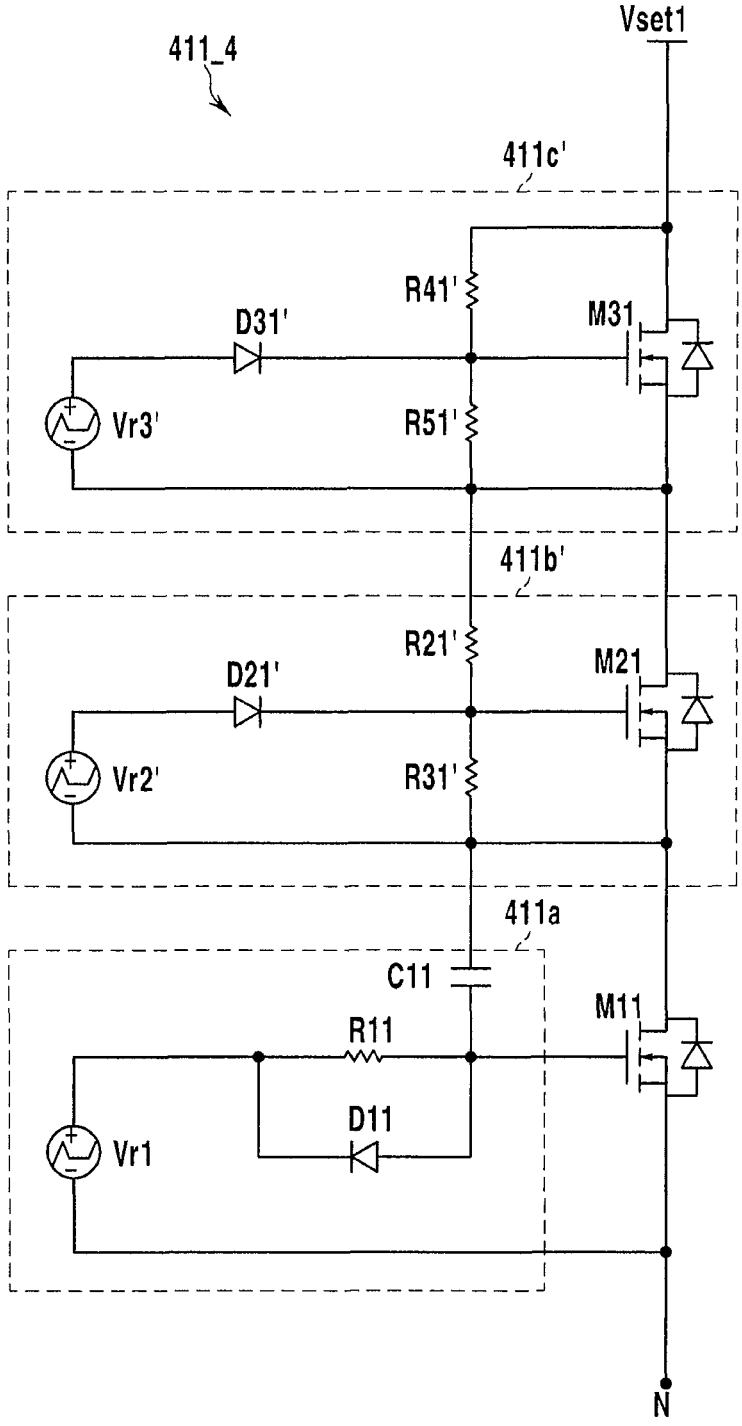

In addition, as shown in FIG. 10, the rising reset driver 411_4 is the same (or substantially the same) as the rising reset driver 411_2 as shown in FIG. 8 except that it further includes a driver 411*c*'. The driver 411*c*' includes a transistor M31, resistors R41' and R51', a diode D31' and a control signal voltage source Vr3'. A source of the transistor M31, whose drain is connected to the power source Vset1, is connected to the drain of the transistor M21. The two resistors R41' and R51' are connected in series between the drain and source of the transistor M31, and the contact between the two resistors R41' and R51' is connected to a gate of the transistor M31. The control signal voltage source Vr3' is connected between an anode of the diode D31, whose cathode is connected to the contact between the two resistors R41' and R51', and the drain of the transistor M31.

The driver 411*c*' turns off the transistor M31 when the voltage of the Y electrode Yi reaches a certain (or predetermined) voltage, thereby intercepting a path between the voltage source Vset1 and the transistor M21. That is, the voltage Yi of the Y electrode is gradually increased, and then when the voltage Vx of the Y electrode Yi is increased to a certain (or predetermined) voltage Vx, the transistor M31 is turned off. That is, when the gate-source voltage of the transistor M31 is approximately equal to a threshold voltage |Vth| of the transistor M31, the voltage Vx of the node N becomes a voltage Vset3, and the Y electrode Yi can sustain the voltage Vset3 during a certain (or predetermined) period.

Figure 11:
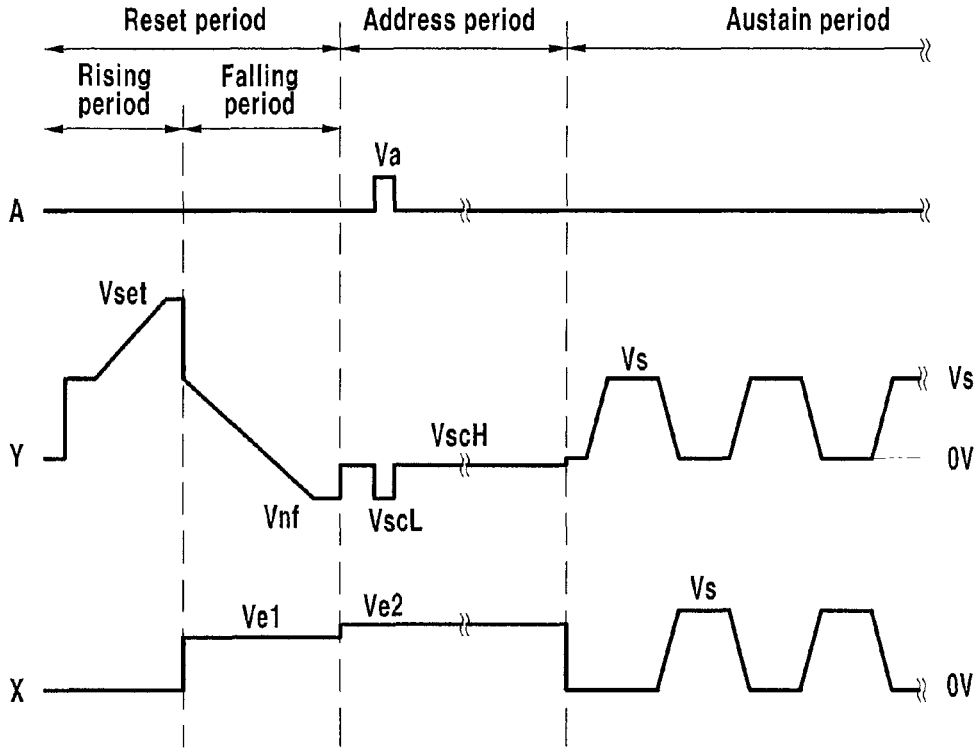
FIG. 11 is a view schematically showing a driving waveform of a plasma display device according to the third exemplary embodiment of the present invention.
Figure 12:
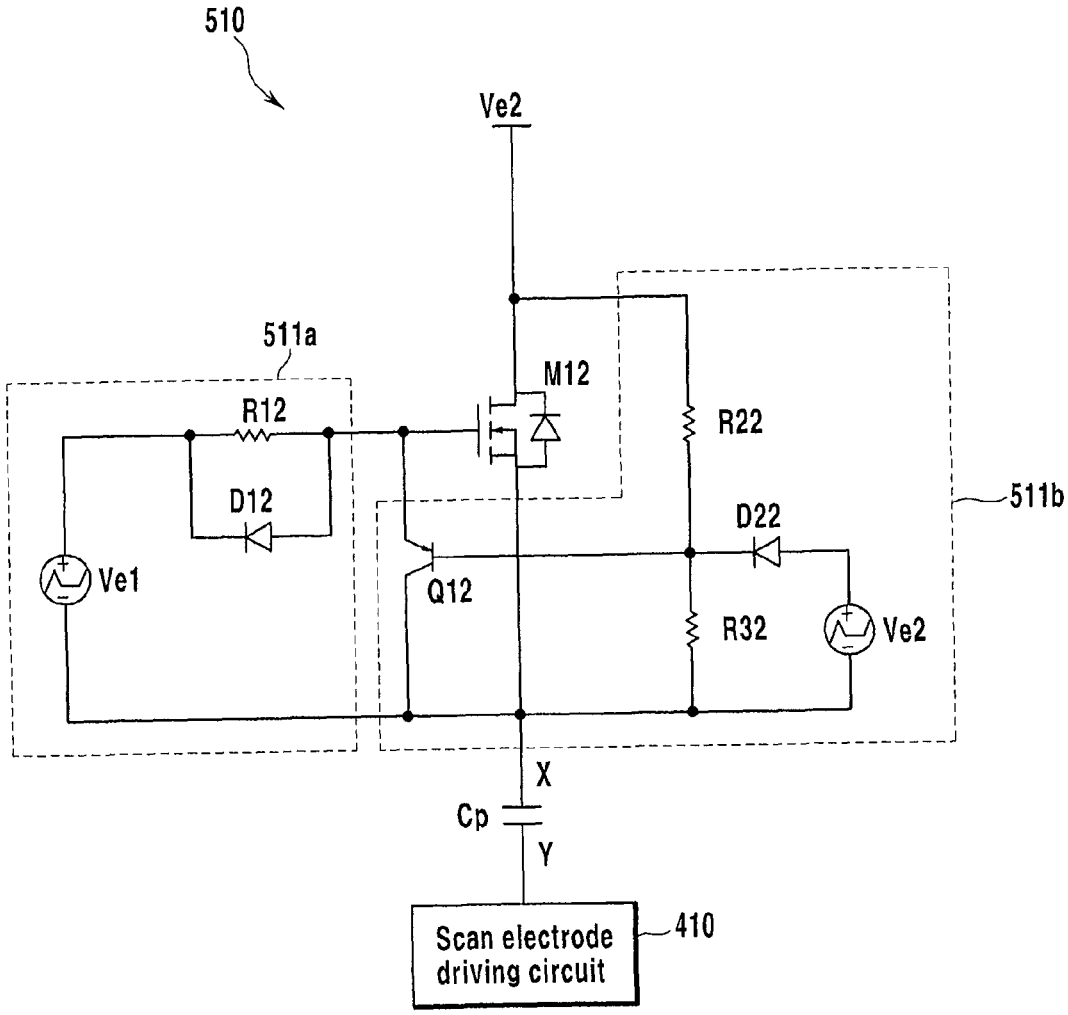
FIGS. 12 and 13 are views schematically showing a sustain electrode driving circuit according to seventh and eighth exemplary embodiments of the present invention.
Figure 13:
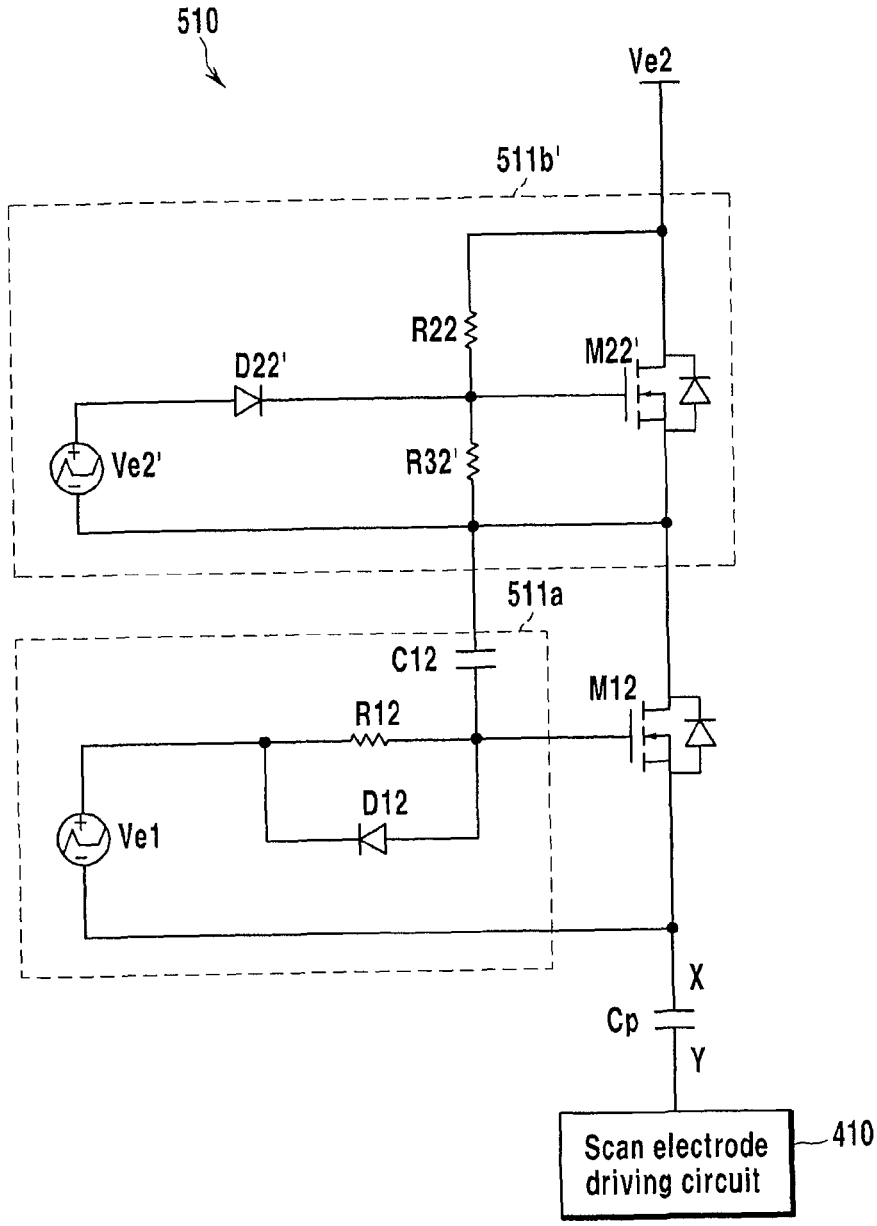
Figure 11:
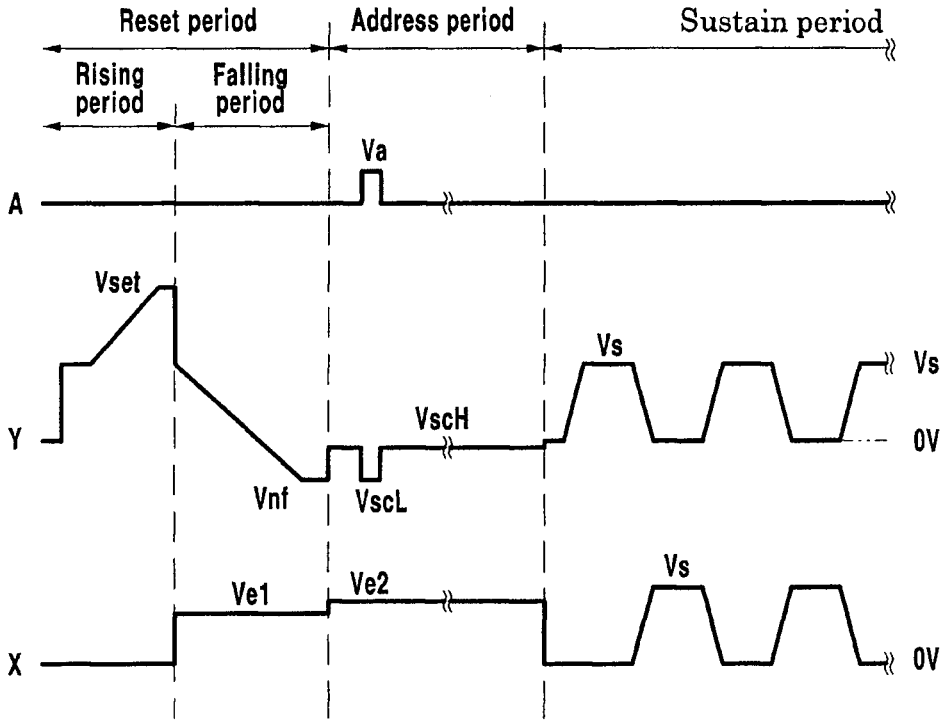

FIG. 11 is a view showing a driving waveform of a plasma display device according to the third exemplary embodiment of the present invention. FIGS. 12 and 13 are views showing a sustain electrode driving circuit according to seventh and eighth exemplary embodiments of the present invention.

As shown in FIG. 11, a voltage Ve1 is applied to the X electrode in the falling period of the reset period, and voltage Ve2 higher than the voltage Ve1 is applied to the X electrode in the address period. In this way, a voltage difference between the Y electrode and the X electrode becomes larger in the address period, thereby easily causing an address discharge. In this way, even when the voltages Ve1 and Ve2 applied to the X electrode in the falling period of the reset period and in the address period are different from each other, the driving circuit as shown in FIG. 3 or 5 is applied. Thus, if the driving circuit is constructed as shown in FIGS. 12 and 13, the voltages Ve1 and Ve2 can be supplied by one power source Ve2. The driving circuit as show in FIGS. 12 and 13 can be formed in the sustain electrode driver 500.

That is, as shown in FIG. 12, the driving circuit 510 includes a transistor M12 and drivers 511*a* and 511*b*. The driver 511*a* includes a resistor R12, a diode D12, and a control signal voltage source Ve1, and the driver 511*b* includes a transistor Q12, resistors R22 and R32, a diode D22, and a control signal voltage source Ve2. Here, a drain of the transistor M12 is connected to the power source Ve2 supplying the voltage Ve2, and a source of the transistor M12 is connected to the X electrode X. The control signal voltage source Ve1 is connected between the gate of the transistor M12 and the X electrode X, and the resistor R12 is connected between the control signal voltage source Ve1 and the gate of the transistor M12. In addition, the diode D12 is connected in parallel to both terminals of the resistor R12. The transistor M12 is driven by the driver 511*a*, thereby applying the voltage Ve2 to the X electrode X.

The two resistors R22 and R32 are connected in series between the drain of the transistor M12 and the X electrode X, and a contact between the two resistors R22 and the R32 is connected to the base of the transistor Q12. A collector of the transistor Q12 is connected to the X electrode X, and an emitter of the transistor Q12 is connected to a gate of the transistor M12. In addition, the cathode of the diode D22 is connected to the contact between the two resistors R22 and R32, and the control voltage signal source Ve2 is connected between the anode of the diode D22 and the X electrode X. The driver 511*b* turns on the transistor Q12 when the voltage of the X electrode X reaches a certain (or predetermined) voltage in the reset period, thereby intercepting a path between the transistor M12 and the X electrode. That is, when the voltage of the X electrode X becomes a certain (or predetermined) voltage, the transistor Q12 is turned on. Accordingly, when the base-collector voltage of the transistor Q12 is approximately equal to a threshold voltage |Vth| of the transistor Q12, the voltage of the X electrode is determined to be a voltage Ve1, and the X electrode X can sustain the voltage Ve1 during a certain (or predetermined) period. In addition, if the transistor Q12 is turned off for a certain (or predetermined) period, the voltage Ve2 can be applied to the X electrode X.

As shown in FIG. 13, the driving circuit 510' is the same (or substantially the same) as the driving circuit 510 as shown in FIG. 12 except for the driver 511*b*'. The driver 511*b*' includes a transistor M22', resistors R22' and R32', a diode D22' and a control signal voltage source Ve2'. A drain of the transistor M22' is connected to the power source Ve2, and a source of the transistor M22' is connected to a drain of the transistor M12. The two resistors R22' and R32' are connected in series between the drain of the transistor M22' and the source of the transistor M22', and a contact between the two resistors R22' and R32' is connected to a gate of the transistor M22'. The control signal voltage source Ve2' is connected between an anode of the diode D22', whose cathode is connected to the contact between the two resistors R22' and R32', and the source of the transistor M22'.

The driver 511*b'* turns off the transistor M22' when the voltage of the X electrode Yi reaches a certain (or predetermined) voltage in the reset period, thereby intercepting a path between the transistor M12 and the X electrode.

That is, if the voltage of the X electrode X becomes a certain (or predetermined) voltage, the transistor M22' is turned off. Here, when the gate-source voltage of the transistor M22' is approximately equal to a threshold voltage |Vth| of the transistor M22', the voltage of the X electrode X is determined to be a voltage Ve1, and the X electrode X can sustain the voltage Ve1 during a certain (or predetermined) period. In addition, if the transistor M22' is turned on for a certain (or predetermined) period, the voltage Ve2 can be applied to the X electrode X.

According to embodiments of the present invention, two or more voltage levels can be outputted by one power source, thus the number of power sources in a plasma display device can be reduced.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display device comprising:

an electrode;

a first transistor connected between the electrode and a power source for supplying a first voltage and comprising a first terminal and a second terminal, a voltage of the first terminal corresponding to a voltage of the electrode and a voltage of the second terminal corresponding to the first voltage;

a first driver adapted to drive the first transistor to change the voltage of the electrode; and a second driver adapted to sustain the voltage of the electrode substantially at a second voltage differing from the first voltage by intercepting a path between the first transistor and the power source when the voltage of the electrode is changed into the second voltage in a first period, and to change the voltage of the electrode substantially back to the first voltage in a second period.

2. The plasma display device of claim 1, wherein the first voltage is lower in voltage level than the second voltage.

3. The plasma display device of claim 2, wherein the second driver comprises:

a first resistor and a second resistor, the first and second resistors being connected in series between the first terminal of the first transistor and the power source;

a second transistor connected between the control terminal of the first transistor and the power source and comprising a control terminal connected to the contact between the first and second resistors; and a control signal voltage source adapted to supply a control signal, for turning off the second transistor, to the control terminal of the second transistor during the second period.

4. The plasma display device of claim 2, wherein the second driver comprises:

a first resistor and a second resistor, the first and second resistors being connected in series between the first terminal of the first transistor and the electrode;

a second transistor connected between the first terminal of the first transistor and the electrode and comprising a control terminal connected to the contact between the first and second resistors; and a control signal voltage source adapted to supply a control signal, for turning on the second transistor, to the control terminal of the second transistor during the second period.

5. The plasma display device of claim 1, wherein the first voltage is higher in voltage level than the second voltage.

6. The plasma display device of claim 5, wherein the second driver comprises:

a first resistor and a second resistor, the first and second resistors being connected in series between the power source and the second terminal of the first transistor;

a second transistor connected between the control terminal of the first transistor and the first terminal of the first transistor and comprising a control terminal connected to the contact between the first and second resistors; and a control signal voltage source adapted to supply a control signal, for turning off the second transistor, to the control terminal of the second transistor during the second period.

7. The plasma display device of claim 5, wherein the second driver comprises:

a first resistor and a second resistor, the first and second resistors being connected in series between the second terminal of the first transistor and the power source;

a second transistor connected between the second terminal of the first transistor and the power source and comprising a control terminal connected to the contact between the first and second resistors; and a control signal voltage source adapted to supply a control signal, for turning on the second transistor, to the control terminal of the second transistor during the second period.

8. The plasma display device of claim 1, wherein the electrode corresponds to a cell of the plasma display device, wherein the reset period comprises the first period, wherein the address period comprises the second period, and wherein the first voltage is a voltage to be applied to the electrode of the cell during the address period to turn on the cell.

9. The plasma display device of claim 1, wherein the reset period comprises the first period, wherein the address period comprises the second period, and wherein the electrode is biased at the first voltage in a third period after the second period during the address period, and the electrode is biased at the second voltage in a fourth period after the first period during the reset period.

10. A plasma display device comprising:

an electrode;

a first transistor connected between the electrode and a power source and comprising a first terminal and a second terminal, a voltage of the first terminal corresponding to a voltage of the electrode and a voltage of the second terminal corresponding to a voltage of the power source;

a first driver adapted to drive the first transistor to change the voltage of the electrode;

a first resistor and a second resistor, the first and second resistors being connected in series between the electrode and the power source;

a second transistor comprising a control terminal and adapted to turn on in response to a voltage of a node of the first and second resistors applied to the control terminal to turn off the first transistor when the second transistor is turned on; and a control signal voltage source adapted to supply a control signal, for turning off the second transistor, to the control terminal of the second transistor during a period.

11. The plasma display device of claim 10, wherein the first transistor is an NMOS transistor and comprising a control terminal, wherein the first terminal of the first transistor is a drain and the second terminal is a source, and wherein the second transistor is connected between the control terminal of the first transistor and the power source.

12. The plasma display device of claim 10, wherein the first transistor is an NMOS transistor and comprising a control terminal, wherein the first terminal of the first transistor is a source and the second terminal of the first transistor is a drain; and wherein the second transistor is connected between the control terminal of the first transistor and the power source.

13. A plasma display device comprising:

an electrode;

a first transistor connected between the electrode and a power source and comprising a first terminal and a second terminal, a voltage of the first terminal corresponding to a voltage of the power source and a voltage of the second terminal corresponding to a voltage of the electrode;

a first driver adapted to drive the first transistor to change the voltage of the electrode;

a second transistor comprising a first terminal, a second terminal, and a control terminal, wherein the second transistor is adapted to be turned on in response to a voltage of a node of a first resistor and a second resistor, the first and second resistor being connected to each other in series and to both the first and second terminals of the second transistor, and wherein the second transistor is further adapted to intercept a path between the power source and the electrode when the second transistor is turned off; and a control signal voltage source adapted to supply a control signal, for turning off the second transistor, to the control terminal of the second transistor during a period.

14. The plasma display device of claim 13, wherein the first transistor is an NMOS transistor, wherein the first terminal of the first transistor is a drain and the second terminal of the first transistor is a source, and wherein the second transistor is connected between the power source and the first terminal of the first transistor.

15. The plasma display device of claim 13, wherein the first transistor is an NMOS transistor, wherein the first terminal of the first transistor is a drain and the second terminal of the first transistor is a source, and wherein the second transistor is connected between the electrode and the first terminal of the first transistor.

16. A driving method of a plasma display device including an electrode, the method comprising:

turning on a first transistor connected between the electrode and a power source for supplying a first voltage to change a voltage of the electrode;

sustaining the voltage of the electrode substantially at a second voltage differing from the first voltage by intercepting a path between the electrode and the power source when the voltage of the electrode is changed into the second voltage; and changing the voltage of the electrode substantially back to the first voltage through the path between the electrode and the power source.

17. The method of claim 16, wherein the sustaining of the voltage of the electrode substantially at the second voltage comprises: turning on a second transistor connected between the control terminal of the first transistor and the power source, wherein the changing of the voltage of the electrode substantially back to the first voltage comprises: turning off of the second transistor, and wherein the first voltage is lower in voltage level than the second voltage.

18. The method of claim 16, wherein the sustaining of the voltage of the electrode substantially at the second voltage comprises: turning on of a second transistor connected between the electrode and the first transistor, wherein the changing of the voltage of the electrode substantially back to the first voltage comprises: turning off of the second transistor, and wherein the first voltage is lower in voltage level than the second voltage.

19. The method of claim 16, wherein the sustaining of the voltage of the electrode substantially at the second voltage comprises: turning on of a second transistor connected between the control terminal of the first transistor and the electrode, wherein the changing of the voltage of the electrode substantially back to the first voltage comprises: turning off of the second transistor, and wherein the first voltage is higher in voltage level than the second voltage.

20. The method of claim 16, wherein the sustaining of the voltage of the electrode substantially at the second voltage comprises: turning off of a second transistor connected between the power source and the first transistor, wherein the changing of the voltage of the electrode substantially back to the first voltage comprises: turning on of the second transistor, and wherein the first voltage is higher in voltage level than the second voltage.

* * * * *

UNITED STATES PATENT AND TRADEMARK OFFICE

CERTIFICATE OF CORRECTION

PATENT NO. : 7,755,574 B2
APPLICATION NO. : 12/018128
DATED : July 13, 2010
INVENTOR(S) : Joo-Yul Lee It is certified that error appears in the above-identified patent and that said Letters Patent is hereby corrected as shown below:

In the Drawings

FIG. 11, Sheet 11 of 13:

Delete Drawing Sheet 11 and substitute therefor the Drawing Sheet, consisting of FIG. 11, as shown on the attached page.

Signed and Sealed this
Eleventh Day of October, 2011

David J. Kappos

David J. Kappos
*Director of the United States Patent and Trademark Office*